US008376152B2

(12) United States Patent
Holmes, Jr.

(10) Patent No.: US 8,376,152 B2
(45) Date of Patent: Feb. 19, 2013

(54) HANDGUN STORAGE STACK

(76) Inventor: William S. Holmes, Jr., Acton, MA (US)

( * ) Notice: Subject to any disclaimer, the term of this patent is extended or adjusted under 35 U.S.C. 154(b) by 0 days.

(21) Appl. No.: 13/463,088

(22) Filed: May 3, 2012

(65) Prior Publication Data

US 2012/0267282 A1 Oct. 25, 2012

Related U.S. Application Data

(63) Continuation of application No. PCT/US2010/056201, filed on Nov. 10, 2010.

(60) Provisional application No. 61/260,484, filed on Nov. 12, 2009.

(51) Int. Cl.
*A47F 7/00* (2006.01)

(52) U.S. Cl. ..... 211/64

(58) Field of Classification Search ..... 211/64, 211/36, 4, 60.1, 13.1, 184, 59.2; 42/70.11, 42/70.01; 312/242, 271; 206/317, 493, 526; 109/58, 64, 78
See application file for complete search history.

(56) References Cited

U.S. PATENT DOCUMENTS

| | | | | | |
|---|---|---|---|---|---|
| 439,562 | A | * | 10/1890 | Richards | 206/317 |
| 1,833,081 | A | * | 11/1931 | Kilmer | 217/36 |
| 1,932,638 | A | * | 10/1933 | Rogers | 206/317 |
| 2,740,530 | A | * | 4/1956 | Ponder | 211/64 |
| 3,031,069 | A | * | 4/1962 | Hirsch | 206/317 |
| 4,113,107 | A | * | 9/1978 | Jaeger | 211/4 |
| 4,333,623 | A | | 6/1982 | May | |
| 4,461,385 | A | * | 7/1984 | Clouser | 211/4 |
| 4,776,471 | A | | 10/1988 | Elkins | |
| 5,118,175 | A | * | 6/1992 | Costello | 312/242 |
| 5,143,227 | A | | 9/1992 | Schubert | |
| 5,265,950 | A | * | 11/1993 | Atkinson | 312/216 |
| 5,772,295 | A | * | 6/1998 | Sundmark | 312/246 |
| 5,957,308 | A | | 9/1999 | Zierenberg | |
| 6,042,207 | A | | 3/2000 | Crosby et al. | |
| 6,405,861 | B1 | * | 6/2002 | Siler et al. | 206/317 |
| 7,159,711 | B1 | * | 1/2007 | Gardner | 206/317 |
| 7,409,790 | B2 | * | 8/2008 | Stepp | 42/70.01 |
| 7,478,892 | B2 | | 1/2009 | Punzel et al. | |
| 7,524,002 | B2 | | 4/2009 | Punzel et al. | |
| 7,584,861 | B2 | | 9/2009 | Werner | |
| 7,770,740 | B2 | * | 8/2010 | Punzel et al. | 211/64 |
| 8,104,313 | B2 | * | 1/2012 | Wolfe | 70/63 |
| 2005/0230334 | A1 | * | 10/2005 | MacDonald et al. | 211/64 |
| 2006/0027514 | A1 | * | 2/2006 | Carlson et al. | 211/72 |
| 2006/0283820 | A1 | | 12/2006 | Peters et al. | |
| 2007/0024165 | A1 | | 2/2007 | Moulton | |
| 2010/0263253 | A1 | * | 10/2010 | Giebel et al. | 42/70.11 |
| 2012/0261368 | A1 | * | 10/2012 | Klein et al. | 211/64 |

* cited by examiner

*Primary Examiner* — Jennifer E Novosad
(74) *Attorney, Agent, or Firm* — Darlene A. Vanstone, Esq.; Carolyn S. Elmore, Esq.; Elmore Patent Law Group, PC

(57) ABSTRACT

In one embodiment, the present invention provides a free-standing handgun stack for storing multiple handguns in a single column vertical stacking arrangement. In another embodiment the invention provides a handgun stack for storing multiple handguns in a single column vertical stacking arrangement wherein the handgun stack is retrofitable or inserted for permanent or removable attachment to the inside of a gun safe. In one aspect of this embodiment, the gun stack is configured to a height and width that takes up about the same amount of space as a long gun if such long gun were disposed or secured in a vertical position in the same space within the gun safe.

9 Claims, 6 Drawing Sheets

HANDGUN STORAGE STACK

RELATED APPLICATIONS

This application is a continuation of International Application No. PCT/US2010/56201, which designated the United States and was filed on Nov. 10, 2010, published in English, which claims the benefit of U.S. Provisional Application No. 61/260,484, filed on Nov. 12, 2009. The entire teachings of the above applications are incorporated herein by reference.

BACKGROUND OF THE INVENTION

There has been an ongoing search for the convenient storage of handguns including but not limited to pistols and revolvers. Often, handguns are stored on their sides either in drawers or on shelves. Handguns take up significant space when stored in this manner. This is particularly troublesome for individuals who collect handguns and have limited storage space. This dilemma is compounded by the laws of some states and jurisdictions that require guns to be stored in locked enclosures such as gun safes, to prevent unauthorized use of guns by third parties. Most gun safes manufactured today do not provide a convenient means for storing multiple handguns within the safe in a space-saving manner. Space is a premium in a safe and the storage of multiple handguns quickly takes up available space in the safe. A convenient means for storing multiple handguns in any location and particularly in an enclosure having limited space such as a gun safe is desirable.

SUMMARY OF THE INVENTION

In one embodiment, the present invention provides a free-standing handgun stack for storing multiple handguns in a single column vertical stacking arrangement.

In another embodiment the invention provides a handgun stack for storing multiple handguns in a single column vertical stacking arrangement wherein the handgun stack is retrofitable for permanent or removable attachment to the inside of a gun safe. In one aspect of this embodiment, the gun stack is configured to a height and width that takes up about the same amount of space as a long gun if such long gun were disposed or secured in a vertical position in the same space within the gun safe.

In accordance with the invention, the handgun stack of the invention is suitable for holding at least two handguns in a single column vertical stacking arrangement wherein each handgun comprises a grip and a barrel, wherein the handgun stack comprises:

a pair of opposing vertical side walls; and at least two slots vertically arranged one on top of the other disposed between the pair of side walls and supported by the side walls, wherein each slot has a top surface and a bottom surface extending at a downward angle from a front access opening through the slot to a rear exit opening, wherein each slot is separately accessible through the front access opening, wherein each slot is separately adapted to receive a handgun through the front access portion; each slot providing the bottom surface upon which the handgun rests in an upright position, wherein upon placing the handgun in the slot through the front access opening, the barrel of the handgun is preferably angled downward and away from the front access opening and extends toward or through the rear exit opening and the grip of the handgun is angled upward and extends out of the front access portion of each slot.

In one embodiment, the individual slots of the handgun storage stack are not angled down, but are instead configured at 90° to the side walls and parallel to the floor.

BRIEF DESCRIPTION OF THE DRAWINGS

The invention is explained and described in more detail below using embodiments shown in the drawings. The described and drawn features in other embodiments of the invention can be used individually or in preferred combinations. The foregoing and other objects, features and advantages of the invention will be apparent from the following more particular description of the preferred embodiments of the invention, as illustrated in the accompanying drawings in which reference characters refer to the same parts throughout the different views. The drawings are not necessarily to scale, emphasis instead being placed on illustrating principals of the invention in a clear manner.

DETAILED DESCRIPTION OF THE INVENTION

Figure 1:
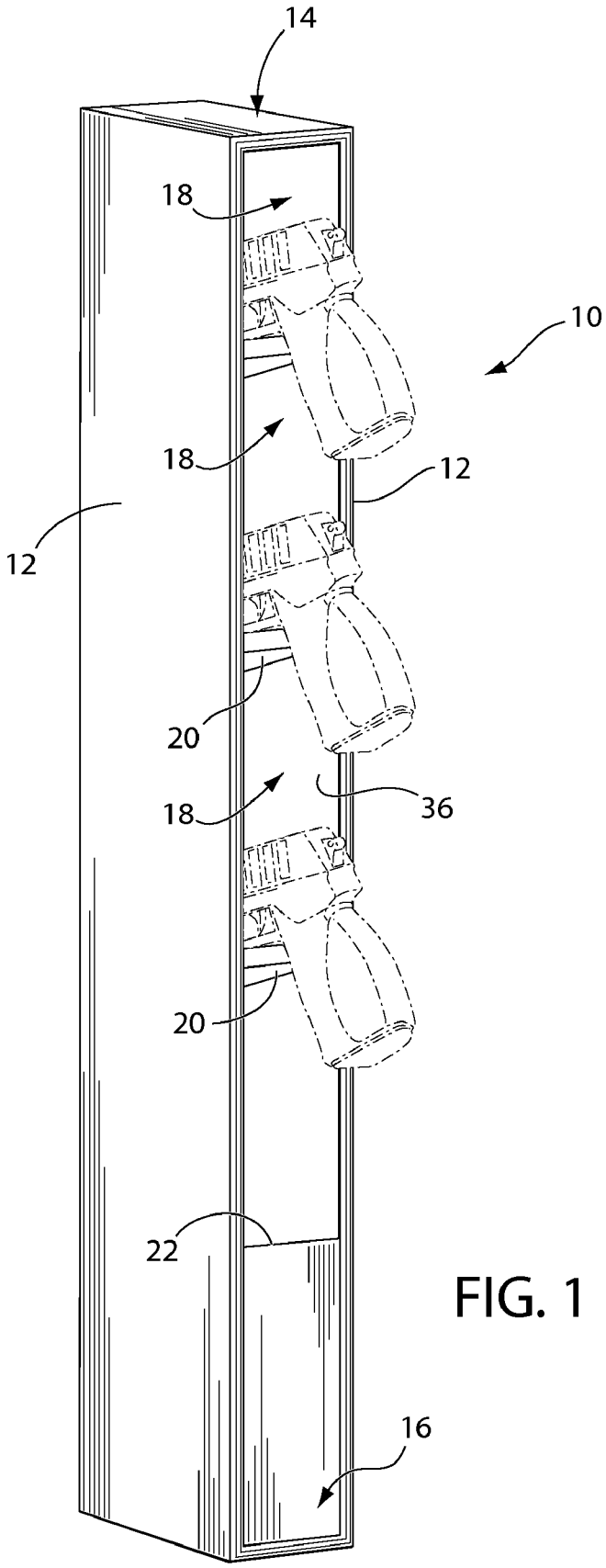
FIG. 1 is a perspective view of the invention.

Referring now to FIG. 1, the handgun stack of the invention is shown generally at 10 comprising a pair of opposing side walls 12; optionally, a top 14 and optionally a base 16. At least two handgun storage and receiving slots 18 are vertically arranged one on top of the other and disposed between the pair of side walls 12 and having interior sides 36 defined by the side walls 12, wherein each slot has a top surface 20 and a bottom surface 22. In one embodiment, the handgun stack 10 of the invention is free standing and is supported on and by the base 16.

Figure 2:
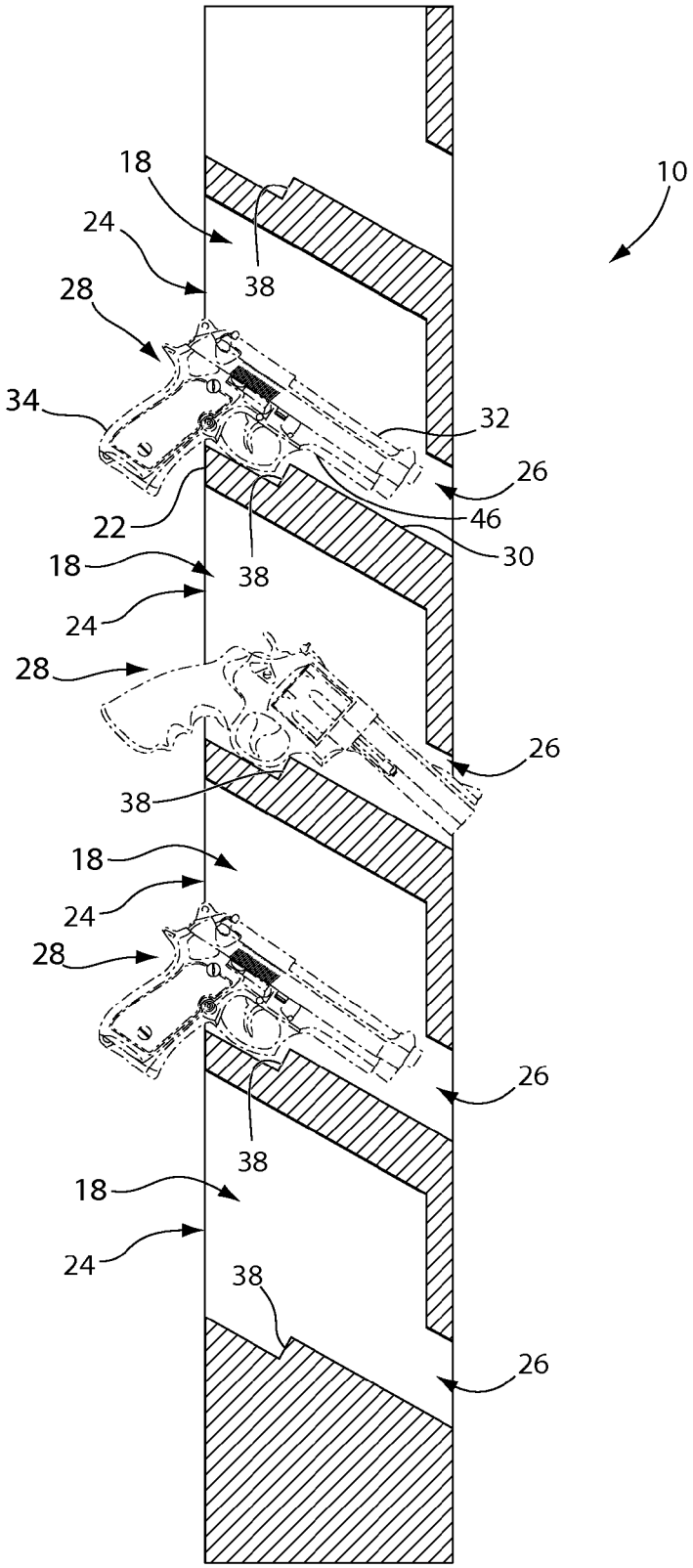
FIG. 2 is a cutaway side view of the invention.

Turning now to FIG. 2, each slot 18 extends at a downward angle from a front access opening 24 through the slot to a rear exit opening 26, wherein each slot 18 is separately accessible through the front access opening 24, wherein each slot is separately adapted to receive a handgun 28 through the front access opening 24; each slot providing the bottom surface 30 upon which the handgun 28 rests in a generally upright position, wherein upon placing the handgun 28 in the slot 18 through the front access opening 24, the barrel 32 of the handgun 28 is angled downward and away from the front access opening 24 and extends toward or through the rear exit opening 26 and the grip 34 of the handgun 28 is angled upward and extends out of the front access portion 24 of each slot 18.

In one embodiment, the total width of handgun stack 10 is only slightly larger than the width of most standard long guns resting in an upright position thereby facilitating space saving. The total length of the handgun stack 10 can be of any convenient size or height. In a preferred embodiment, the width and length of the handgun stack of the invention are about the same as the width and length of the space in a gun safe designated for the securing and holding of one long gun such as a rifle, scoped rifle, shotgun or scoped shotgun as will be discussed in more detail below with respect to FIG. 3, thereby facilitating retrofitting, inserting, or otherwise installing of the handgun stack into a gun safe wherein the handgun stack takes up about the same amount of space as a long gun in the safe.

The slots 18 of the handgun stack of the invention can be adapted to fit a handgun of almost any size, including handguns with long barrels or custom stocks or scopes. As shown in FIG. 2, the bottom surface 22 of the slot may include a step up 38 against which the trigger guard 46 of the handgun 28 rests for further security in the slot 18. It is another benefit that the gun stack of the invention presents a gun to a user in a safe manner oriented and positioned exactly where the user can easily grip it, but with the barrel facing away from the user for added safety.

Referring again to FIG. 1, the top surface 20, the bottom surface 22, and the sides 36 of slots 18 may be lined with a non-abrasive material including but not limited to felt, cotton, or other soft synthetic material such as polyester or rayon to prevent scratching of the gun surface. In one embodiment, the top surface 20, the bottom surface 22, and the sides 36 slots 18 may be partially or fully padded with foam or the like, such as to render the gun generally immobile against the padding once the gun is placed in the slot.

The handgun stack of the invention may be made of any suitable material that is strong enough to support the weight of a plurality of handguns that may be stored in the handgun stack. Such materials include but are not limited to wood, plastics, metals or other composite lightweight materials.

Figure 3:
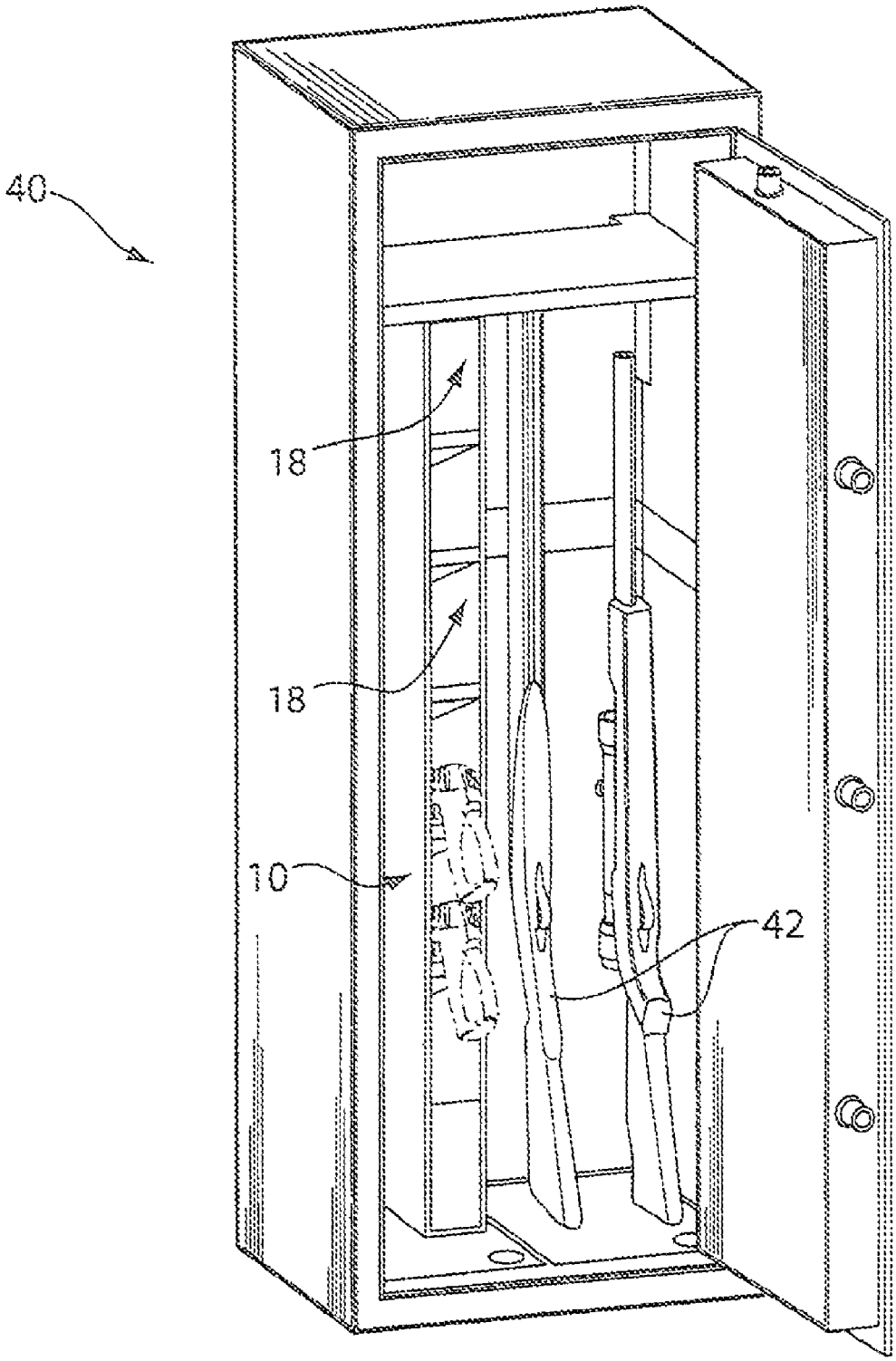
FIG. 3 is a perspective view of a gun safe wherein the handgun stack of the invention is installed inside of the gun safe.

Referring now to FIG. 3, the handgun stack 10 of the invention may be conveniently retrofitted to a gun safe 40. In one embodiment, the handgun stack 10 of the invention is configured to have a width and length that occupies about the same space as a long gun 42 when stored in the safe 40. The actual length may vary depending on the size of the gun safe, but the width can be determined based on the average width of the most popular types of long guns. In one embodiment, the total width of the handgun stack of the invention may range from about 1.5" to about 4". In one embodiment the width of the interior of a slot may range from about 1.0" to about 3.9". In one embodiment, the width of the gun stack is 2.25 inches wide. In one embodiment the depth of the gun stack is 6 inches. In one embodiment the height of the gun stack is 45 inches. The handgun stack of the invention may be removably or permanently retrofitted to the interior of a safe. For permanent attachment, many safes are manufactured with brackets and bracket extenders offset from one of the interior walls, usually the back wall of the safe for receiving or securing long guns. The handgun stack of the invention may be suitably designed to include cut outs or holes through which a bolt can be inserted into the preexisting bracket of the gun safe thereby securing the handgun stack to an interior surface of the gun safe. This arrangement is particularly convenient as the offset of the bracket from the back wall of the gun safe also offsets the rear opening of the gun stack from the back wall thereby leaving room for any gun barrels protruding through the rear opening 26 of the gun stack as shown in FIG. 2.

In another embodiment, the handgun stack of the invention may be removably secured within a gun safe using a hook and loop arrangement such as VELCRO®. In this embodiment, an interior rear surface of a gun safe for example is capable of receiving and mating with a corresponding hook and loop surface that is attached to the exterior rear portion of the gun stack of the invention.

Figure 4A:
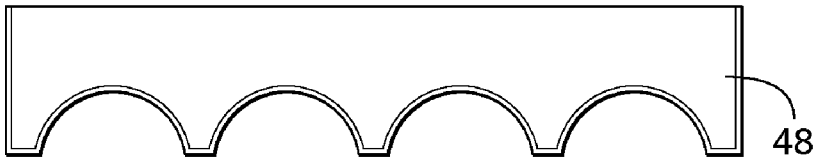
FIG. 4A is a top down view of the configuration of a first gun safe interior surface element.
Figure 4C:
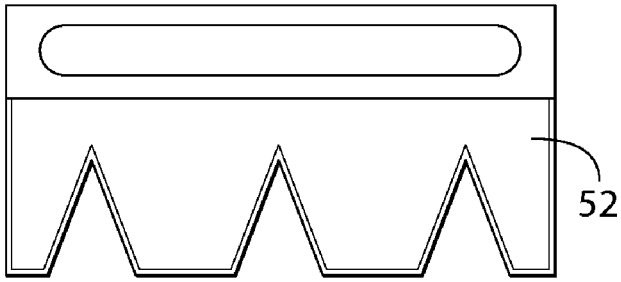
FIG. 4C is a top down view of the configuration of a second gun safe interior surface element.
Figure 4B:
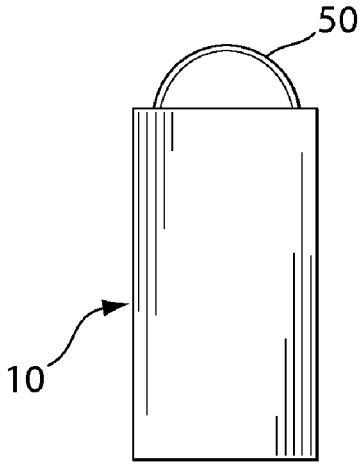
FIG. 4B is a top down view of the hand gun stack showing a first interlocking element on the exterior of the handgun stack that is configured to mate with a first gun safe interior surface element of FIG. 4A.
Figure 4D:
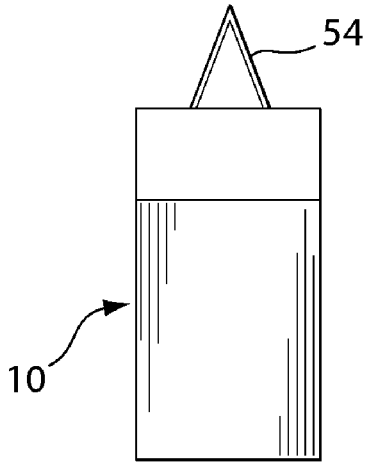
FIG. 4D is a top down view of the hand gun stack showing the second interlocking element on the exterior of the handgun stack that is configured to mate with the second gun safe interior surface element of FIG. 4C.

In an another embodiment the handgun stack may be removably secured within the gun safe using a system of straps, such as bungee cords, which can be simply wrapped around the gun stack of the invention and hooked on one or more interior surfaces or brackets located in the interior of the gun safe. In yet another embodiment, an exterior surface (e.g. the rear exterior surface) of the gun stack of the present invention may include one or more elements that are configured and sized to mate with one or more corresponding elements in the gun safe adapted to hold a long gun. FIG. 4A shows a configuration of a first gun safe interior surface element 48. FIG. 4B shows a first interlocking element 50 on the exterior surface of the handgun stack 10 that is configured to mate with the first gun safe interior surface element 48 of FIG. 4A. Likewise, FIG. 4C also shows a configuration of a second gun safe interior surface element 52. A second interlocking element 54 on the exterior surface of the handgun stack 10 is shown in FIG. 4D and is configured to mate with the second gun safe interior surface element 52 of FIG. 4C.

Figure 5:
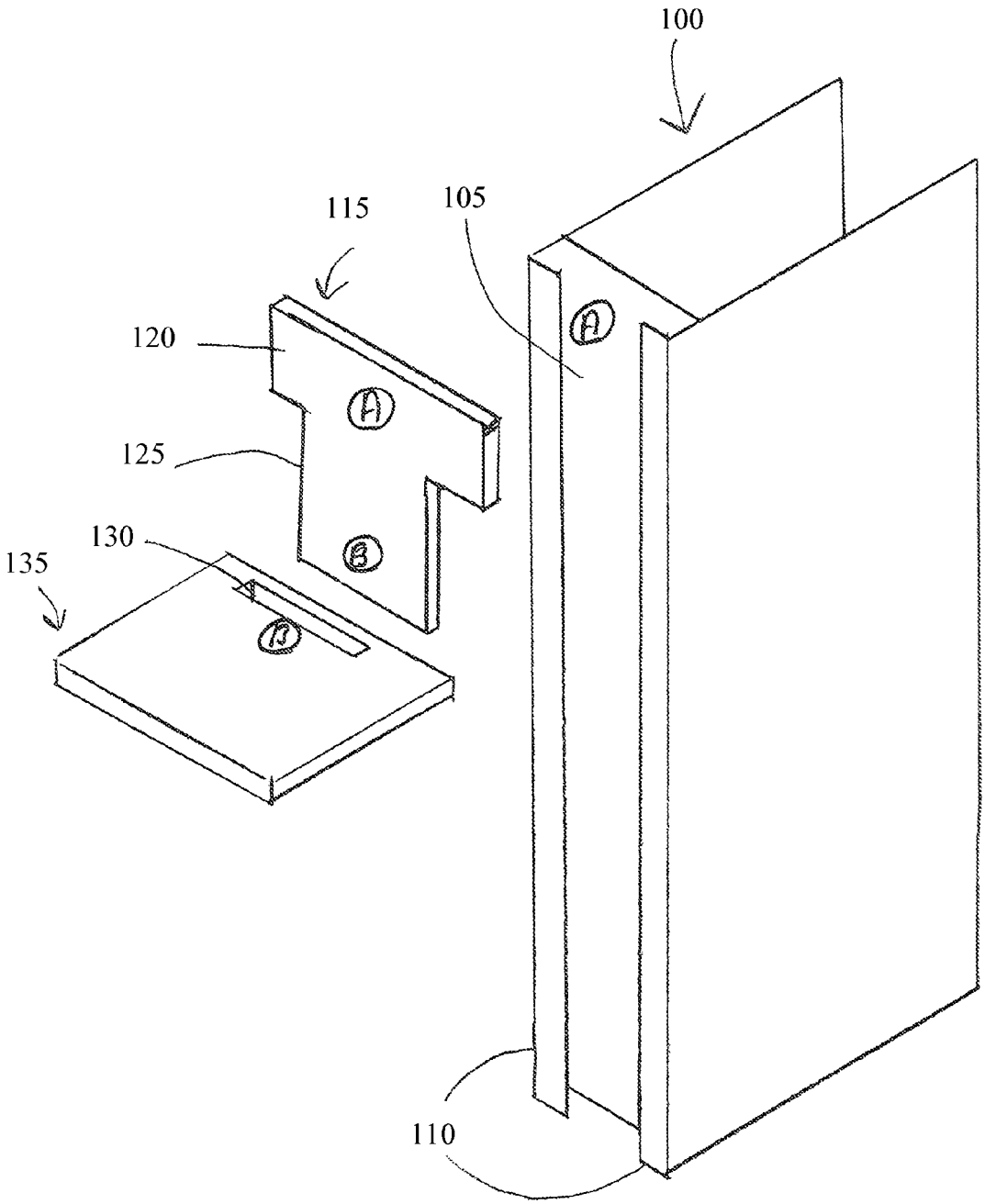
FIG. 5 is a perspective view of one embodiment showing a configuration for securing the handgun stack to the interior of a gun safe.

FIG. 5 shows another embodiment for removably securing the handgun stack within a gun safe. In this embodiment, the rear exterior surface 105 of the handgun stack 100 is fitted with opposing parallel shafts 110 that extend longitudinally along the rear surface 105 of the handgun stack 100. The shafts 110 are capable of receiving the head 120 of the T-shaped key 115 which in turn can be slid up and down the shafts 110. The stem 125 of the T-shaped key 115 is capable of fitting into an opening 130 (e.g. such as a slot) of the plate 135. The plate 135 is in turn adapted to be secured onto an interior surface of a gun safe such as is shown in FIG. 6.

Figure 7:
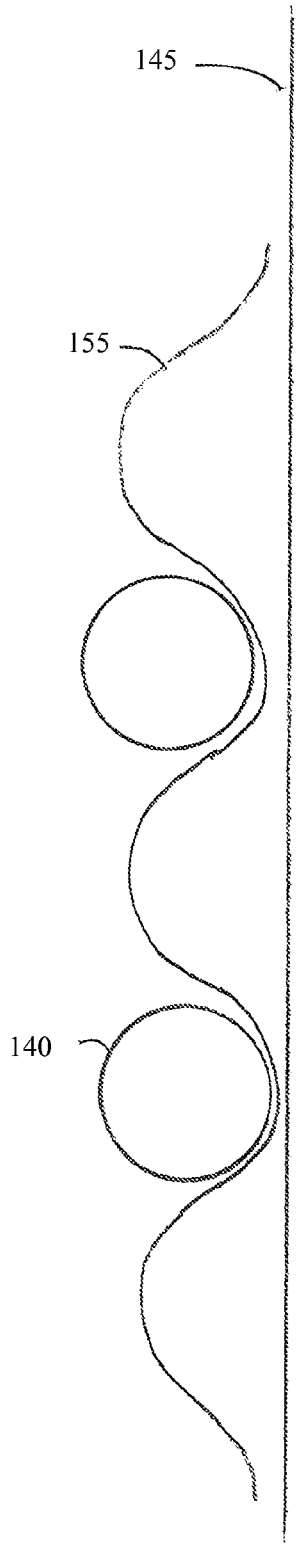
FIG. 7 is a top down view showing an alternative configuration of FIG. 5 for securing the handgun stack to the interior surface of a gun safe.

An alternative embodiment of FIG. 5 is shown in FIG. 7 where instead of using the plate 130, the plate 130 is substituted with a ring 140 shown in FIG. 7 wherein the stem 125 of the T-shaped key 115 shown in FIG. 5 is capable of being received by the ring 140 of FIG. 7.

Figure 6:
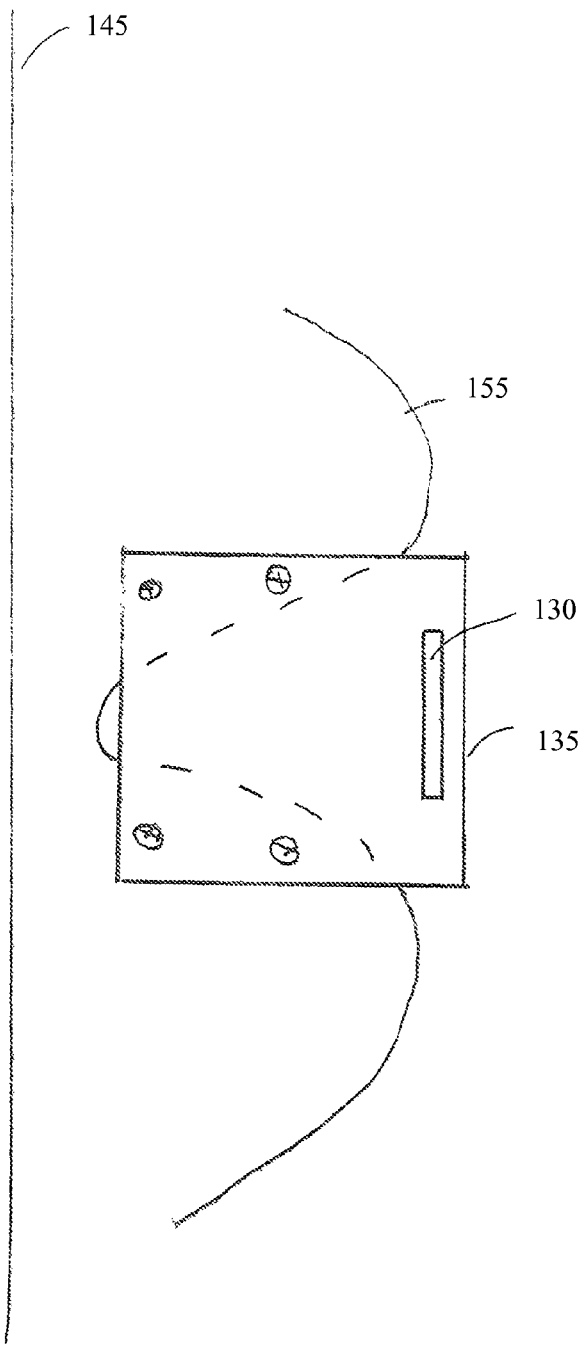
FIG. 6 is a top down view showing one configuration of FIG. 5 for securing the handgun stack to the interior surface of a gun safe.

The embodiments of FIGS. 5, 6 and 7 show that the plate 135 of FIG. 5 or the ring 140 of FIG. 7 is secured to the interior surface 145 of a gun safe such as an interior element 155 of the gun safe which may be curved and configured to hold a long gun all as shown in FIGS. 6 and 7. In operation, the head 120 of the T-shaped key 115 as shown in FIG. 5 is inserted into the shafts 110 on the rear of the handgun stack 100 as shown in FIG. 5. In turn the stem 125 of the T-shaped key 115 is then slid along the shafts 110 and inserted into the opening 130 of the plate 135 of FIGS. 5 and 6. Alternatively, the stem 125 of the T-shaped key as shown in FIG. 5 is inserted into the ring 140 of FIG. 7. For each embodiment said respective ring 140 of FIG. 7 or plate 135 of FIG. 6 have been previously secured by the user to the interior surface element 155 of a gun safe 145 as shown in FIGS. 6 and 7.

It is understood that the gun stack of the invention may be fitted to, installed in or otherwise optionally secured in any enclosed space such as a closet, or armoire or display case.

The gun stack may also be conveniently placed in a locker or even a firearms safe room such as that a police department may have for convenient access to firearms. The gun stack may remain free standing in any such place or may be removably or permanently secured in any such enclosed space or safe room as described herein.

While this invention has been particularly shown and described with references to preferred embodiments thereof, it will be understood by those skilled in the art that various changes in form and details may be made therein without departing from the scope of the invention encompassed by the appended claims.

What is claimed is:

1. A handgun storage stack for holding at least two handguns in a single column vertical stacking arrangement, wherein each handgun comprises a grip, a trigger guard and a barrel, wherein said handgun stack comprises:

a pair of opposing vertical side walls defining a space between them; and at least two divider elements, each divider element extending from a first opposing vertical side wall to the other of the pair and displaced vertically one from another between said pair of opposing vertical side walls, said at least two divider elements forming at least two slots arranged vertically one on top of the other and disposed between the pair of side walls and having sides defined by the pair of opposing vertical side walls, wherein each slot has a top surface and a bottom surface extending at a downward angle from a front access opening through the slot to a rear exit opening, wherein each top surface is formed by one of said divider elements and each bottom surface is formed by another of said divider elements, wherein each slot is separately accessible through a front access opening, wherein each slot is separately configured and adapted to receive a handgun through the front access opening; wherein the handgun storage stack is configured for receiving a handgun such that the handgun is capable of resting on the bottom surface of each slot in an upright position, wherein upon placing the handgun in the slot through the front access opening, the barrel of the handgun is angled downward and away from the front access opening and extends toward or through a rear exit opening and the grip of the handgun is angled upward and extends out of the front access portion of each slot.

2. The handgun storage stack of claim 1 further comprising a support base, coupled to a bottom region of said pair of opposing vertical side walls, wherein the gun stack is free-standing and supported by said support base.

3. The handgun gun storage stack of claim 1, wherein the slots are partially or fully padded.

4. The handgun storage stack of claim 1, wherein the bottom surface of the slot comprises a step up against which a trigger guard of a handgun contained within the slot, rests.

5. The handgun storage stack of claim 1, which comprises a configuration such that the handgun storage stack is capable of being retrofitted or removably inserted into the same space configured to receive a long gun in a gun safe.

6. The handgun storage stack of claim 5, wherein the configuration comprises opposing parallel shafts disposed on the rear exterior surface of the handgun storage stack into which the head of a T-shaped key can be inserted slid up and down within the shafts and wherein the stem of the T-shaped key is configured to be inserted into an opening on a plate or a ring that is secured to an interior element of a gun safe configured to receive a long gun.

7. A gun safe comprising the handgun storage stack of claim 1.

8. The gun safe of claim 7, wherein the handgun storage stack is permanently or removably secured within the gun safe.

9. An enclosure comprising the handgun storage stack of claim 1, wherein the gun stack is free standing or permanently or removably secured in the enclosure.

* * * * *